United States Patent [19]

Seeney et al.

[11] 4,383,861

[45] May 17, 1983

[54] METAL SILICO-PHOSPHATE BINDERS AND FOUNDRY SHAPES PRODUCED THEREFROM

[75] Inventors: Charles E. Seeney, Brazil; John F. Kraemer; Janis Ingebrigtsen, both of Terre Haute, all of Ind.

[73] Assignee: International Minerals & Chemical Corp., Terre Haute, Ind.

[21] Appl. No.: 342,312

[22] Filed: Jan. 25, 1982

[51] Int. Cl.[3] ..... B28B 7/34

[52] U.S. Cl. ..... 106/38.3; 106/38.9; 164/528; 164/37

[58] Field of Search ..... 106/38.3, 38.35, 38.9; 164/528, 37

[56] References Cited

U.S. PATENT DOCUMENTS

| | | | |
|---|---|---|---|
| 4,209,056 | 6/1980 | Gardikes et al. | 106/38.9 |
| 4,247,333 | 1/1981 | Ledder | 106/38.9 |
| 4,357,165 | 11/1982 | Helferich et al. | 106/38.9 |

*Primary Examiner*—Lorenzo B. Hayes

*Attorney, Agent, or Firm*—Robert H. Dewey

[57] ABSTRACT

A hydrogel binder for a foundry aggregate comprising, in combination, a metal silico-phosphate and as a hardener therefor a mixture of aluminum dihydrogen phosphate, water and phosphoric acid and a process for manufacturing molds and cores from same.

18 Claims, No Drawings

METAL SILICO-PHOSPHATE BINDERS AND FOUNDRY SHAPES PRODUCED THEREFROM

This invention relates to an improved process for preparing foundry cores and molds. In a particular aspect this invention relates to an improved hydrogel binder for the aggregate and process for preparing it.

Binders for foundry aggregates used for making foundry cores and molds for metal castings are usually organic in nature, i.e. organic polymers and resins. These organic compounds are decomposed or volatilized when the molten metal contacts the core or mold and the resulting fumes and vapors cause a problem of air pollution. There is, therefore, a need to provide an all inorganic, non-volatile binder which is non-contaminating to the environment.

SUMMARY OF THE INVENTION

It is an object of this invention to provide an improved process for preparing foundry molds and cores using a foundry aggregate and a binder therefor.

It is another object of this invention to provide an improved hydrogel binder for foundry aggregate and a process for preparing it.

Other objects of this invention will be apparent to those skilled in the art from the disclosure herein.

It is the discovery of this invention to provide an improved process for preparing foundry cores and molds using a foundry aggregate and a binder therefor. The improvement is provided by using as a binder a silico-phosphate, such as the reaction product of a metal dihydrogen phosphate, e.g. the zinc, or preferably, the potassium compound with a mineral silicate, including but not limited to zeolites, nepheline syenite and preferably olivine. For convenience, this preferred product has been designated potassium olivine phosphate, or simply KOP. A combination of aluminum dihydrogen phosphate, water and phosphoric acid is used as the hardening agent for the binder.

DETAILED DISCUSSION

Metal silico-phosphates useful in the practice of this invention are easily prepared by mixing the metal dihydrogen phosphate, e.g. potassium dihydrogen phosphate with a silicate mineral, e.g. olivine, and heating the mixture to above the melting point of the metal dihydrogen phosphate for about one hour. For example, potassium dihydrogen phosphate melts at about 810° C. and the zinc salt melts at about 1000° C. The reactants should be comminuted and preferably pass a 200 mesh sieve. The metal dihydrogen phosphate is preferably added as a dry powder, but it can also be added as an aqueous solution, e.g. a saturated solution, or as a slurry. The proportions of metal dihydrogen phosphate and mineral silicate are not critical, a range of 0.5–10:1 by weight respectively being useful. However, a proportion of about 2:1 by weight is preferred, especially when the reactants are potassium dihydrogen phosphate and olivine.

During the heating process, the mixture forms a very viscous polymeric melt. The metal dihydrogen phosphate is converted to the metal polyphosphate which dissolves and reacts with the silicate, after which it is allowed to cool. As it cools, it hardens and becomes increasingly brittle and after equilibration at room temperature and normal relative humidity (50%) it crumbles easily. The metal silico-phosphate should be prepared in a heat-resistant and acid-resistant vessel, e.g. ceramic. Steel is rapidly attacked by the reaction mixture at elevated temperatures. The preferred silico-phosphate is that prepared from potassium dihydrogen phosphate and olivine.

According to the process of this invention, the aggregate is first mixed with ground silico-phosphate, e.g. KOP, in an amount of about 1–12% based on the weight of the aggregate. A preferred amount is in the range of about 1–10% and about 3% is particularly preferred. After mixing the aggregate with the silico-phosphate, there is added a hardener with further thorough mixing. The order of mixing these ingredients is not critical. It is preferred to mix the solids first, followed by the liquids to assist in thorough blending of the mixture. The mixture of aggregate, binder and hardener is now rapidly delivered to the mold or core box where it is permitted to cure for 120 minutes or to a compression strength of about 50 psi as measured by a Dietert tester. The core or mold is then removed and is allowed to further harden under ambient conditions for several hours or overnight.

The hardener useful in the practice of this invention is a combination of aluminum dihydrogen phosphate, water and phosphoric acid. The ADP and water are used in approximately equal parts by weight. Preferably the ADP is dissolved or slurried in the water before being mixed with the aggregate. ADP is commercially available as a 50% aqueous solution, e.g. from Stauffer Chemical Company, and this solution is convenient for use as it supplies both the ADP and the water. All quantities of ADP disclosed herein are those of the 50% solution, not the dry weight. The ADP solution is used in an amount of about 1 to about 10% based on the aggregate, preferably about 2% and the phosphoric acid is also used in an amount of about 1% to about 10%, preferably about 2%, based on the weight of the aggregate. The preferred amounts are, therefore, 3% KOP (or other silico-phosphate), 2% ADP, and 2% black phosphoric acid. The ADP and phosphoric acid, being liquids, are usually mixed together and added as one component.

This binder combination is a hydrogel, i.e. a coagulated colloid with the inclusion of water. Too much water causes the core or mold to be soft and too pliable to hold the desired shape. Too little water causes the core or mold to be brittle, friable and easily crumbled. However, within an acceptable range of temperature, e.g. 60°–100° F., and humidity, e.g. 30–80% RH, adequate handling characteristics are obtained. When molten metal contacts the hydrogel-bonded core, the water is vaporized, reducing the core to freeflowing sand, which is easily shaken out of the core or mold box.

The foundry aggregate useful in the practice of this invention can be any known aggregate such as silica sand, zircon, olivine, alumino silicate sand (zeolite), chromite sand, and the like. Olivine is a preferred aggregate. The aggregate should be of a particle size consistent with desired result.

The orthophosphoric acid used in the practice of this invention can be the commercial, 85% grade. However, the preferred acid is wet process acid and the so-called black acid is particularly preferred because it contains metal ions which enhance the cure rate and tensile strength. The grade designated "green acid" is also a useful acid. Black acid is customarily about 10% concentration and can be used as is, or it can be further diluted by 50% to about 35%. Green acid is about 40% by weight.

Olivine sand is the preferred aggregate for use with the improved binder of this invention. It is a natural mineral consisting of a solid solution rich in magnesium orthosilicate (Fosterite) with a minor amount of ferric orthosilicate (Fayalite). Olivine is a major component of dunite rock. Peridotite is another olivine-bearing rock. Typically, olivine has a composition falling within the following general ranges:

MgO:40–52% by weight
$SiO_2$:35–45% by weight
FeO:6.5–10% by weight
$Al_2O_3$, $K_2O$, $Na_2O$: Trace Any olivine falling within the above ranges is suitable for the practice of this invention.

The invention will be better understood with reference to the following examples. It is understood that these examples are intended only to illustrate the invention and it is not intended that the invention be limited thereby.

EXAMPLE 1

North Carolina olivine sand, 1500 g, was mixed with 60 g of KOP prepared by reacting three parts of potassium dihydrogen phosphate with 1 part of olivine from the state of Washington to give 4% by weight based on the sand. Then 75 g of 50% aqueous solution of aluminum dihydrogen phosphate (to provide 2.5% by weight of ADP) and 30.0 g of orthophosphoric acid (to provide 2% by weight) were added with mixing. The coated sand was then packed into dog-bone-shaped, no-bake molds. Compressive strength was measured at two hours. The cores were then removed from the molds and left in the laboratory to air dry overnight, after which the tensile strength was determined. The data are given in Table 1.

TABLE 1

| Example Number | KOP | ADP Solution | $H_3PO_4$ | Compressive Strength | Tensile Strength |
|---|---|---|---|---|---|
| 1 | 4% | 5% | 2% | 42 psi | 115 psi |
| 2 | 2 | 1 | 1 | 28 | 35.6 |
| 3 | 2 | 2 | 1 | 22 | 39.5 |
| 4 | 4 | 2 | 1 | 30 | 25.0 |
| 5 | 4 | 5 | 2 | 40 | |

EXAMPLES 2–5

The experiment of Example 1 was repeated in all essential details except that the proportions of binder components were varied. The data are given in Table 1.

EXAMPLES 6–8

The experiment of Example 1 was repeated in all essential details except that the KOP was prepared from potassium acid phosphate and olivine in a ratio of 1:1 by weight, and the amounts of binder components were varied. The tensile strength was measured after the cores cured overnight. It was then heated to 900° C. for two hours, cooled to room temperature and the tensile strength was measured again. The results are given in Table 2.

TABLE 2

| Example Number | KOP | ADP Solution | $H_3PO_4$ | Compressive Strength | Tensile Strength Pre* | Tensile Strength Post** |
|---|---|---|---|---|---|---|
| 6 | 4% | 5% | 2% | 30 psi | 160 psi | 60 psi |
| 7 | 2 | 2.5 | 1 | 45 | 65 | 25 |

TABLE 2-continued

| Example Number | KOP | ADP Solution | $H_3PO_4$ | Compressive Strength | Tensile Strength Pre* | Tensile Strength Post** |
|---|---|---|---|---|---|---|
| 8 | 1 | 1.25 | 0.5 | 45 | 40 | 5 |

*Before heating.
**After heating.

EXAMPLES 9

The experiment of Example 1 is repeated in all essential details except that a zeolite is substituted for olivine in the reaction with potassium dihydrogen phosphate. The mold thereby obtained has good compressive strength.

EXAMPLE 10

The experiment of Example 1 is repeated in all essential details except that nepheline syenite is substituted for olivine in the reaction with potassium dihydrogen phosphate. The mold thereby obtained has good compressive strength.

We claim:

1. A hydrogel binder composition for a foundry aggregate comprising, in admixture, a metal silico-phosphate selected from the group consisting of potassium olivine phosphate and zinc olivine phosphate and a hardener consisting of a mixture of aluminum dihydrogen phosphate, water and phosphoric acid.

2. A core or mold consisting essentially of a foundry aggregate and the binder of claim 1.

3. The binder of claim 1 wherein the metal silico-phosphate is potassium olivine phosphate.

4. The binder of claim 1 wherein the metal silico-phosphate is zinc olivine phosphate.

5. The core or mold of claim 2 wherein the potassium olivine phosphate is used in a proportion of about 1–12% based on the aggregate.

6. The core or mold of claim 5 wherein the potassium olivine phosphate is used in a proportion of about 1–10%.

7. The core or mold of claim 5 wherein the potassium olivine phosphate is used in a proportion of about 3%.

8. The core or mold of claim 2 wherein the aluminum dihydrogen phosphate is used as an aqueous solution in a proportion of about 1–10% based on the aggregate.

9. The core or mold of claim 8 wherein the aluminum dihydrogen phosphate solution is of about 50% concentration and is used in a proportion of about 2% based on the aggregate.

10. The core or mold of claim 2 wherein the phosphoric acid is used in a proportion of about 1 to about 10% based on the aggregate.

11. The core or mold of claim 10 wherein the phosphoric acid is used in a proportion of about 2%.

12. The core or mold of claim 10 wherein the phosphoric acid is black wet process acid.

13. A process for preparing foundry cores and molds, comprising the steps of (a) mixing an aggregate with a metal silico-phosphate and a hardener consisting of water, phosphoric acid and aluminum dihydrogen phosphate, (b) packing the resulting mixture into a core or mold box and (c) allowing said mixture to stand a length of time sufficient to cure the binder and form the core or mold.

14. The process of claim 13 wherein the aggregate is silica, olivine, zircon, zeolite or chromite sand.

15. The process of claim 13 wherein the metal silico-phosphate is zinc silico phosphate.

16. The process of claim 15 wherein the metal silico-phosphate is zinc olivine phosphate.

17. The process of claim 13 wherein the metal silico-phosphate is potassium silico phosphate.

18. The process of claim 17 wherein the metal silico-phosphate is potassium olivine phosphate.

* * * * *